US005963176A

United States Patent [19]

Solheim et al.

[11] Patent Number: 5,963,176

[45] Date of Patent: Oct. 5, 1999

[54] ANTENNA SYSTEM WITH EDGE TREATMENT MEANS FOR DIMINISHING ANTENNA TRANSMITTING AND RECEIVING DIFFRACTION, SIDELOBES, AND CLUTTER

[75] Inventors: Frederick Solheim; James Jordan, both of Boulder; John Wilson, Longmont, all of Colo.

[73] Assignee: The United States as represented by the Secretary of Commerce, Washington, D.C.

[21] Appl. No.: 08/843,170

[22] Filed: Apr. 14, 1997

[51] Int. Cl.[6] ..... H01Q 1/32

[52] U.S. Cl. ..... 343/841; 343/786

[58] Field of Search ..... 343/778, 777, 343/840, 841, 786, 772

[56] References Cited

U.S. PATENT DOCUMENTS

| | | | |
|---|---|---|---|
| Re. 32,835 | 1/1989 | Howard . | |
| 2,317,464 | 4/1943 | Katzin . | |
| 2,415,807 | 2/1947 | Barrow et al. . | |
| 2,577,463 | 12/1951 | Hansell . | |
| 2,591,486 | 4/1952 | Wilkinson, Jr. . | |
| 2,659,817 | 11/1953 | Cutler . | |
| 2,743,440 | 4/1956 | Riblet . | |
| 2,879,508 | 3/1959 | Ehrlich . | |
| 2,895,134 | 7/1959 | Sichak . | |
| 3,046,550 | 7/1962 | Bartholoma et al. . | |
| 3,611,396 | 10/1971 | Jones, Jr. . | |
| 3,740,755 | 6/1973 | Grenzeback | 343/840 |
| 4,309,709 | 1/1982 | Hill . | |
| 4,419,671 | 12/1983 | Noerpel . | |
| 4,578,681 | 3/1986 | Howard | 343/786 |
| 4,591,867 | 5/1986 | Englund et al. . | |
| 5,111,214 | 5/1992 | Kumpfbeck et al. . | |
| 5,359,338 | 10/1994 | Hatcher, Jr. et al. | 343/778 |

OTHER PUBLICATIONS

Balanis, C.A., Antenna Theory Analysis and Design, 1982, John Wiley and Sons, Inc., pp. 579–587.

Russello, C.A. and Jordan, J.R., "Portable Clutter Fence for UHF Wind Profiling Radar", 1991, Seventh Symposium on Meteorological Observations and Instrumentation, New Orleans, La., Jan. 14–18, 1981.

*Primary Examiner*—Robert H. Kim
*Assistant Examiner*—Tu T. Nguyen
*Attorney, Agent, or Firm*—Stevens, Davis, Miller & Mosher, L.L.P.

[57] ABSTRACT

An antenna shroud or clutter fence has edge treatment for redirecting or absorbing energy which would otherwise be diffracted in an undesired direction. The edge treatment can include an array of corrugations which are about $\lambda/4$ deep for scattering sidelobes. The array of corrugations can be parallel to either the E-wave component or the H-wave component. Alternatively, the edge treatment can include an array of antennas encased in a dielectric extension.

16 Claims, 2 Drawing Sheets

ANTENNA SYSTEM WITH EDGE TREATMENT MEANS FOR DIMINISHING ANTENNA TRANSMITTING AND RECEIVING DIFFRACTION, SIDELOBES, AND CLUTTER

FIELD OF THE INVENTION

The present invention is directed to a directional antenna system for a wind profiling radar or the like and more particularly to such an antenna system with a reduction of diffraction, sidelobes, and clutter.

DESCRIPTION OF THE RELATED ART

It is desired in most antenna systems that the signal be directional. This allows system designers to direct energy in or receive energy from a desired direction. Such directionality increases the gain of antennas, allowing lower transmit power, less sensitive receivers to be utilized, and avoids propagation into or reception from an undesired direction. Directional antennas can also mitigate signal fade caused by reflections and multipath propagation. The need for minimizing these unwanted off-axis effects is increasing with the broadening application of electromagnetic technology, with the increasing population of radio wavebands, and with the need in many applications for higher antenna performance in general. This invention relates to antennas for transmitting and for receiving, and more particularly, minimizes unwanted effects of signal transmitted in and/or received from unwanted directions.

Wind profiling radars are susceptible to contamination from targets in antenna sidelobes. Radar return from buildings, trees, power lines, vehicles, and the ocean surface cause errors in the measured wind profiles. Ground clutter fences are used around profiler antennas to reduce sidelobes near the horizon and the resulting contamination, (Russell and Jordan, 1991). The effectiveness of these ground clutter fences is limited by diffraction effects at the top edge of the fence which create antenna sidelobes. Diffraction sidelobes also increase the chance of profilers interfering with other devices or other devices interfering with the profiler. Reducing diffraction sidelobe levels can make the profiler easier to license in a crowded spectrum band. This invention describes various edge treatments to reduce antenna sidelobes caused by diffraction.

Methods to minimize unwanted off-axis antenna characteristics have been used for many decades. Examples of methods used to minimize these undesirable effects will now be considered.

(a) Antenna systems have been carefully located and positioned. This technique has been employed to reduce contamination in wind profilers. However, this approach is limited by site availability and suitability, and is limited to certain wavelength scales.

(b) Shrouds, which are panels lined with absorbing material such as carbon-loaded foam, are sometimes placed around dish antennas and other antennas to absorb energy which would otherwise propagate in unwanted directions, but diffraction sidelobes limit the usefulness of this approach.

(c) Sawtooth serrations approximately of the scale of the wavelength are placed on the aperture edge of microwave feed horns to randomize and cause destructive interference in off-axis directions.

(d) Absorbing materials such as carbon-loaded foam by themselves have been implemented in some applications, but can themselves cause reflection and diffraction.

(e) Rectangular or v-shaped corrugations have been implemented in microwave horns to reduce the effects of diffraction in the electric (E) field plane. (Balanis, 1982).

(f) Lenses have also been implemented, but are cumbersome for larger antennas.

(g) Clutter fences, which are metal panels, are sometimes installed around antenna installations to reflect energy away from unwanted targets, but signals diffract over the edges of these fences. Clutter is still a limiting performance factor in many situations. Clutter fences are similar to antenna shrouds in that they are both provided to reduce the energy in sidelobes that are almost perpendicular to and behind the main beam.

None of the above solutions may be sufficient in many applications. Wind profilers use clutter fences that greatly reduce antenna sidelobes, but because of diffraction sidelobes, operation is limited to clutter free locations.

The following references relate to the techniques and problems noted above. The disclosures of all of these references are hereby incorporated by reference into this disclosure.

Balanis, C. A., *Antenna Theory Analysis and Design,* 1982, John Wiley and Sons, Inc., pp. 579–587;

Russell, C. A. and Jordan, J. R., "Portable Clutter Fence for UHF Wind Profiling Radar," 1991, Seventh Symposium on Meteorological Observations and Instrumentation, New Orleans, La.,. Jan. 14–18, 1991;

U.S. Patent Re. 32,835 to Howard, Jan. 17, 1989;

U.S. Pat. No. 2,317,464 to Katzin, Apr. 27, 1943;

U.S. Pat. No. 2,415,807 to Barrow et al, Feb. 18, 1947;

U.S. Pat. No. 2,577,463 to Hansell, Dec. 4, 1951;

U.S. Pat. No. 2,591,486 to Wilkinson, Apr. 1, 1952;

U.S. Pat. No. 2,659,817 to Cutler, Nov. 17, 1953;

U.S. Pat. No. 2,743,440 to Riblet, Apr. 24, 1956;

U.S. Pat. No. 2.879,508 to Ehrlich, Mar. 24, 1959;

U.S. Pat. No. 2,895,134 to Sichak, Jul. 14, 1959;

U.S. Pat. No. 3,046,550 to Bartholomä et al, Jul. 24, 1962;

U.S. Pat. No. 3,611,396 to Jones, Oct. 5, 1971;

U.S. Pat. No. 4,309,709 to Hill, Jan. 5, 1982;

U.S. Pat. No. 4,419,671 to Noerpel, Dec. 6, 1983;

U.S. Pat. No. 4,591,867 to Englund et al, May 27, 1986; and

U.S. Pat. No. 5,111,214 to Kumpfbeck et al, May 5, 1992.

SUMMARY OF THE INVENTION

An object of the invention is to provide a passive system to improve antenna performance and response patterns.

Another object of the invention is to provide such a passive system which achieves off-axis suppression of antenna sensitivity.

Another object of the invention is to provide such a passive system which can be either designed into new antennas or retrofitted to existing antennas.

To achieve these and other objects, the present invention is directed to an antenna shroud or clutter fence having any one of several edge treatments that either redirect or absorb energy that would otherwise be diffracted in an undesired direction. The invention can either include treatment of the electric field (E-wave) component or the magnetic field (H-wave) component or both. The edge treatments have quarter-wave corrugations attached to shroud or clutter fence in either the E-wave direction or the H-wave direction, an array of unloaded antennas in either the E-wave or H-wave direction, or an array of loaded antennas in either the E-wave or H-wave direction.

BRIEF DESCRIPTION OF THE DRAWINGS

Preferred embodiments of the present invention will now be set forth with reference to the drawings, in which.

DETAILED DESCRIPTION OF THE PREFERRED EMBODIMENTS

Figure 1:
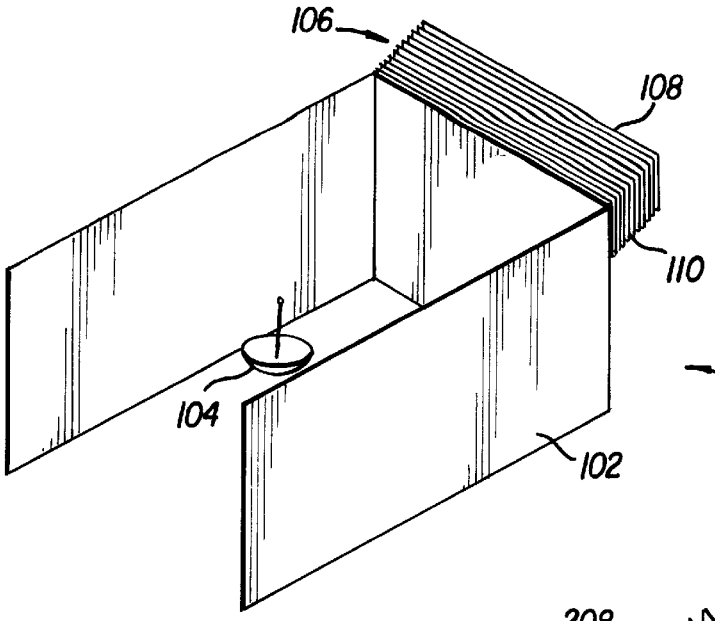
FIG. 1 shows an edge treatment according to a first embodiment of the invention applied to a shroud in the E-wave direction.

FIG. 1 shows a system according to a first embodiment of the present invention. System 100 includes shroud or clutter fence 102 surrounding antenna 104. Assembly 106 of corrugations is applied in the E-plane direction of shroud or clutter fence 102 to minimize off-axis sensitivity. System 100 can be any one of a large family of antenna systems, including wind profilers. In the absence of corrugations, transmitted and received radio waves would diffract over the edge of the clutter fence. Corrugations scatter the energy that would have diffracted back toward the central beam of the antenna. The corrugations either have parallel walls 108 or are V-shaped with a closed bottom. Preferably, the components are approximately ¼ wavelength ($\lambda/4$) deep, open at the top with conducting walls 108 and closed at the bottom 110. The number of corrugations per wavelength is greater than 10, and the corrugation assembly is at least one wavelength across. The angle of the corrugations relative to the panel is dependent upon the desired effect, but might typically be at a slight angle above the local horizon to reduce sensitivity to clutter near the horizon.

Figure 2:
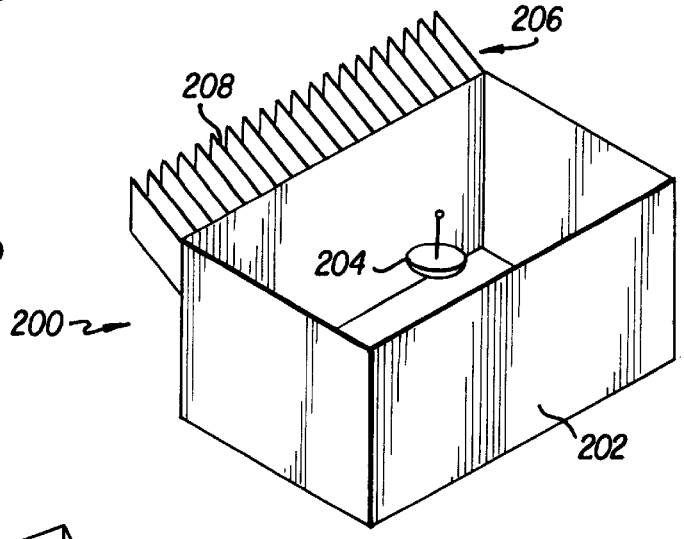
FIG. 2 shows an edge treatment according to the first embodiment of the invention applied to a shroud in the H-wave direction.

The corrugations can also be applied in the H-plane direction, as shown in FIG. 2. In system 200 of FIG. 2, array 206 of corrugations 208 is attached to shroud or clutter fence 202 to reduce diffraction in the H-wave direction of radiation from antenna 202. In this case, the corrugations are constructed in an angular surface such that the E-wave (which is parallel to the diffracting edge) will interact with the corrugations.

Figure 3:
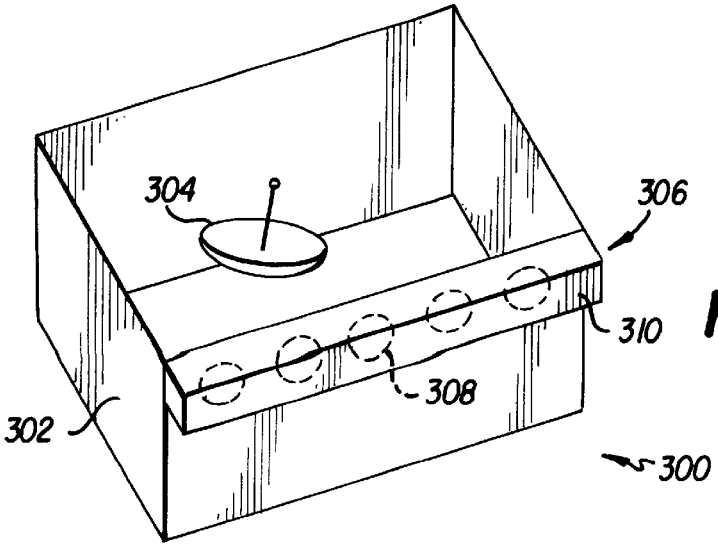
FIG. 3 shows an edge treatment according to a second embodiment of the invention.
Figure 4:
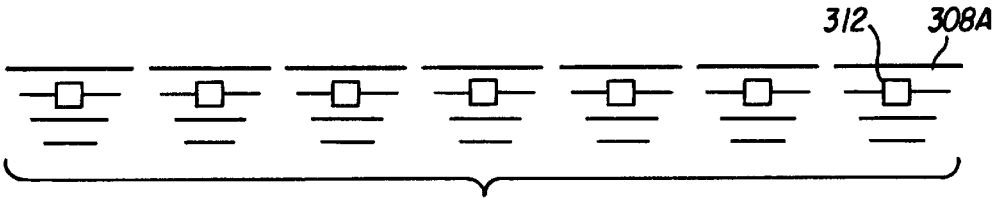
FIGS. 4–7 show antenna arrays which can be used in the edge treatment according to the second embodiment of the invention.
Figure 5:
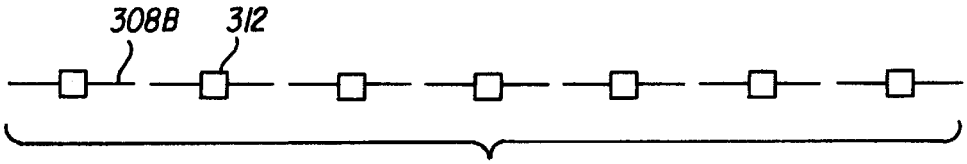
Figure 6:
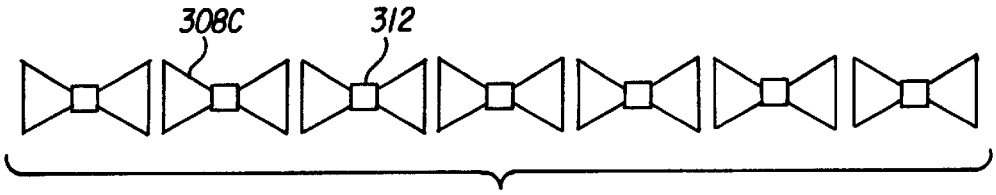
Figure 7:
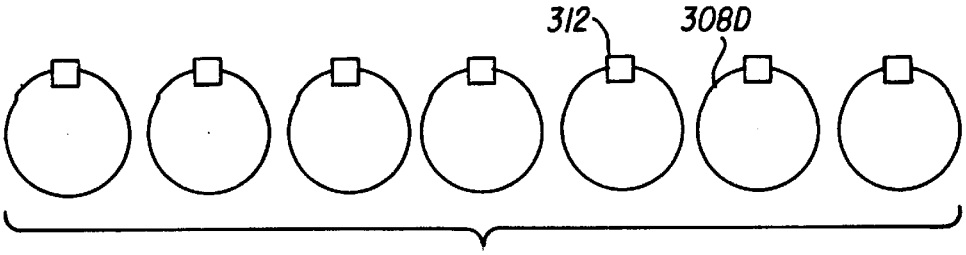

A second embodiment will now be described with reference to FIGS. 3–7. In the second embodiment, as shown in FIG. 3, system 300 includes shroud or clutter fence 302 surrounding antenna 304. Edge treatment 306, instead of including corrugations, includes an array of loaded or unloaded antennas 308, preferably encased in dielectric extension 310. Antennas 308 may be Yagi-Uda antennas 308A of FIG. 4, dipole antennas 308B of FIG. 5, bow tie antennas 308C of FIG. 6, loop antennas 308D of FIG. 7, or other antennas as needed, all with or without resistive terminations 312.

An array of Yagi-Uda antennas can provide enhancement when applied to the H-wave component. An array of passive Yagi-Uda antennas intercept and redirect the diffracted energy into a more desirable direction. An array of other antennas such as, dipole, bow tie, and loop can be used in place of the Yagi-Udas.

An array of simple antennas with a matched resistive load at the feed point can be used as edge treatments on clutter fences to intercept and absorb energy. Any of the above configuration can be used to intercept and dissipate energy in either the E-wave or H-wave directions. The array of antennas can be embedded into a dielectric extension to the clutter fence for mechanical support. Foam is often used to support an antenna array edge treatment.

The present invention passively and compactly produces a difficult-to-attain level of antenna performance in the form of off-axis suppression of antenna sensitivity. This method can be retrofitted or incorporated into design and manufacture. The increase in antenna performance is of high value in many current and future applications. It can improve the signal-to-noise ratio of radio systems, increase the performance and spatial resolution of many radio devices, diminish interference, and reduce transmit power levels and receive sensitivities required.

Although two preferred embodiments have been set forth above, the embodiments may be modified in the ways proposed above or in other ways which will be apparent to those skilled in the art who have reviewed the present disclosure. Therefore, the present invention should be construed as limited only by the appended claims.

What is claimed is:

1. An antenna system comprising:

an antenna for emitting or receiving radiation with an E-wave component and an H-wave component;

an antenna shroud or clutter fence surrounding the antenna; and edge treatment means on the antenna shroud or clutter fence, the edge treatment means comprising an array of corrugations for scattering portions of the radiation.

2. An antenna system as in claim 1, wherein:

the radiation has a wavelength $\lambda$; and the corrugations have a depth of approximately $\lambda/4$.

3. An antenna system as in claim 2, wherein both the antenna shroud or clutter fence and the array of corrugations have top portions which are open.

4. An antenna system as in claim 3, wherein the array of corrugations has a bottom portion which is closed.

5. An antenna system as in claim 4, wherein individual corrugations in the array of corrugations have conductive walls.

6. An antenna system as in claim 5, wherein the conductive walls are parallel to one another.

7. An antenna system as in claim 6, wherein the conductive walls of the individual corrugations are parallel to the E-wave component.

8. An antenna system as in claim 7, wherein:

the antenna shroud or clutter fence has a wall which is parallel to the E-wave component; and the array of corrugations is attached to the wall which is parallel to the E-wave component.

9. An antenna system as in claim 7, wherein:

the antenna shroud or clutter fence has a wall which is parallel to the H-wave component; and the array of corrugations is attached to the wall which is parallel to the H-wave component.

10. An antenna system comprising:

an antenna for emitting or receiving radiation;

an antenna shroud or clutter fence surrounding the antenna; and edge treatment means on the antenna shroud or clutter fence, the edge treatment means comprising an array of further antennas for scattering portions of the radiation.

11. An antenna system as in claim 10, wherein each of the further antennas in the array comprises a resistive load.

12. An antenna system as in claim 10, wherein each of the further antennas is a Yagi-Uda antenna.

13. An antenna system as in claim 10, wherein each of the further antennas is a dipole antenna.

14. An antenna system as in claim 10, wherein each of the further antennas is a bow tie antenna.

15. An antenna system as in claim 10, wherein each of the further antennas is a loop antenna.

16. An antenna system as in claim 10, further comprising a dielectric extension for encasing the further antennas.

* * * * *